US006003587A

United States Patent [19]

Mitsuhashi

[11] Patent Number: 6,003,587

[45] Date of Patent: Dec. 21, 1999

[54] CASTING FURNACE, A CASTING METHOD AND A TURBINE BLADE MADE THEREBY

[75] Inventor: Akira Mitsuhashi, Omiya, Japan

[73] Assignee: Mitsubishi Materials Corporation, Tokyo, Japan

[21] Appl. No.: 08/889,439

[22] Filed: Jul. 8, 1997

[51] Int. Cl.[6] ..... B22D 27/04

[52] U.S. Cl. ..... 164/122.1; 164/126; 164/348

[58] Field of Search ..... 164/122.1, 122.2, 164/348, 126, 128

[56] References Cited

U.S. PATENT DOCUMENTS

| | | | |
|---|---|---|---|
| 1,144,034 | 6/1915 | Giolitti | 164/122.1 |
| 3,763,926 | 10/1973 | Tschinkel et al. | 164/348 |
| 4,108,236 | 8/1978 | Salkeld | 164/122.1 |

FOREIGN PATENT DOCUMENTS

| | | | |
|---|---|---|---|
| 4321640 | 1/1995 | Germany | 164/122.1 |

*Primary Examiner*—Kuang Y. Lin

*Attorney, Agent, or Firm*—Oblon, Spivak, McClelland, Maier & Neustadt, P.C.

[57] ABSTRACT

A casting furnace for forming a large size turbine blade at a high casting rate using a casting alloy which has a single crystal structure or a columnar crystal structure, includes a main tank 2 in which a mold M is placed. A heater 6 heats the periphery of a mold M to a predetermined temperature. The heater is then vertically raised relative to the mold M while a cooling liquid metal immerses and cools the periphery of the heated mold M below the heater. The surface height of the cooling liquid metal is raised according to the rising of the heater.

11 Claims, 5 Drawing Sheets

CASTING FURNACE, A CASTING METHOD AND A TURBINE BLADE MADE THEREBY

BACKGROUND OF THE INVENTION

1. Field of the Invention

This invention relates to a casting furnace and a casting method which makes a single crystal alloy or a columnar crystal alloy used, for example, in a gas turbine in, e.g., an aircraft engine, and a turbine blade which is made by this method.

2. Description of the Related Art

For example, in the fields of gas turbine engines and aircraft engines, a turbine blade and other parts which are made by casting are exposed to very high temperatures during long time operation. Therefore, these parts are required to have high strength at high temperature and casting alloys which have a single crystal structure or a columnar crystal structure are well known to have enough strength in such conditions.

In general, a directional solidification casting method is used to produce such alloys. In this method, molten metal is filled into a mold which is in a cylindrical heating furnace under vacuum or inert gas conditions to heat the periphery of the mold, and then the mold is drawn out gradually from the heating furnace. At this time, the molten metal is solidified from the bottom of the casting mold due to radiation cooling or the use of a chill plate.

However, in this directional solidification method, the temperature gradient at the solidification boundary becomes inadequate for larger size casting parts. Therefore, in the case of casting of a long part such as a turbine blade which is used in a gas turbine engine, the macrostructure of the casting alloy is inferior and it is difficult to obtain a superior single crystal structure or columnar crystal structure along the length of a blade. In addition, in the case of cooling by radiation or using a chill plate, a long cooling time is required and the casting time becomes very long. Therefore, a more rapid casting method is required.

SUMMARY OF THE INVENTION

Accordingly, it is an object of the present invention to overcome these problems.

It is a further object of the invention to provide a superior casting furnace which can make large size parts of a single crystal structure or a columnar crystal structure casting alloy in a shorter time.

It is a yet further object of the invention to provide a superior casting method which can make large size parts of a single crystal structure or a columnar crystal structure casting alloy in a shorter time.

It is yet a further object of the invention to provide a turbine blade which is made by this method.

The casting furnace of the present invention includes a main tank which has a casting mold and has enough capacity to accommodate a cooling liquid metal, a heater to heat the casting mold to a predetermined temperature, the heater being able to rise relative to the casting mold, and cooling means to cool the periphery of the heated mold by immersing it in a cool liquid metal which is supplied into the main tank to raise the height of the cooling liquid metal in the main tank as the heater rises.

In a casting furnace of the present invention, the heater which heats the periphery of the mold in which a molten metal is filled moves vertically while keeping the mold at a predetermined temperature. Simultaneously, the cooling liquid metal is supplied into the main tank to raise to the height of a cooling liquid metal according to the raising of the heating furnace. By this process, the temperature gradient becomes high at the boundary of solidification of molten metals in the casting mold that is near the surface of the cooling liquid metal. Therefore, the casting alloy which has a single crystal structure or a columnar crystal structure has no defects.

In the casting furnace of present invention, it is preferable that the cooling means has a support tank which connects with the main tank and has enough capacity to accommodate a predetermined amount of cooling liquid metal. In this cooling means, a predetermined volume solid is fed into cooling liquid metal in the support tank to supply the cooling liquid metal into the main tank at a rate corresponding to the fed volume of the solid. By this process, the supply of cooling liquid metal to the main tank can be done from a predetermined amount of cooling liquid metal in the support tank and there is no need to supply fresh cooling liquid metal.

The casting method of the present invention comprises the steps of heating a mold containing a liquid alloy capable of forming a single crystal casting or a columnar crystal casting; and progressively immersing the mold in a cooling molten metal at such a rate that the liquid alloy solidifies adjacent the level of the surface of the cooling molten metal.

In the casting process of the present invention, a casting alloy which has no defects and has a single crystal structure or a columnar crystal structure can be obtained by producing a high temperature gradient at the rising solidified boundary of molten metal in the casting mold.

A turbine blade of the present invention is made by the casting method. Since a turbine blade which is made by the casting method is made from a casting alloy which has no defects and has a single crystal structure or a columnar crystal structure that extends parallel to the blade length, it has enough strength at high temperature.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
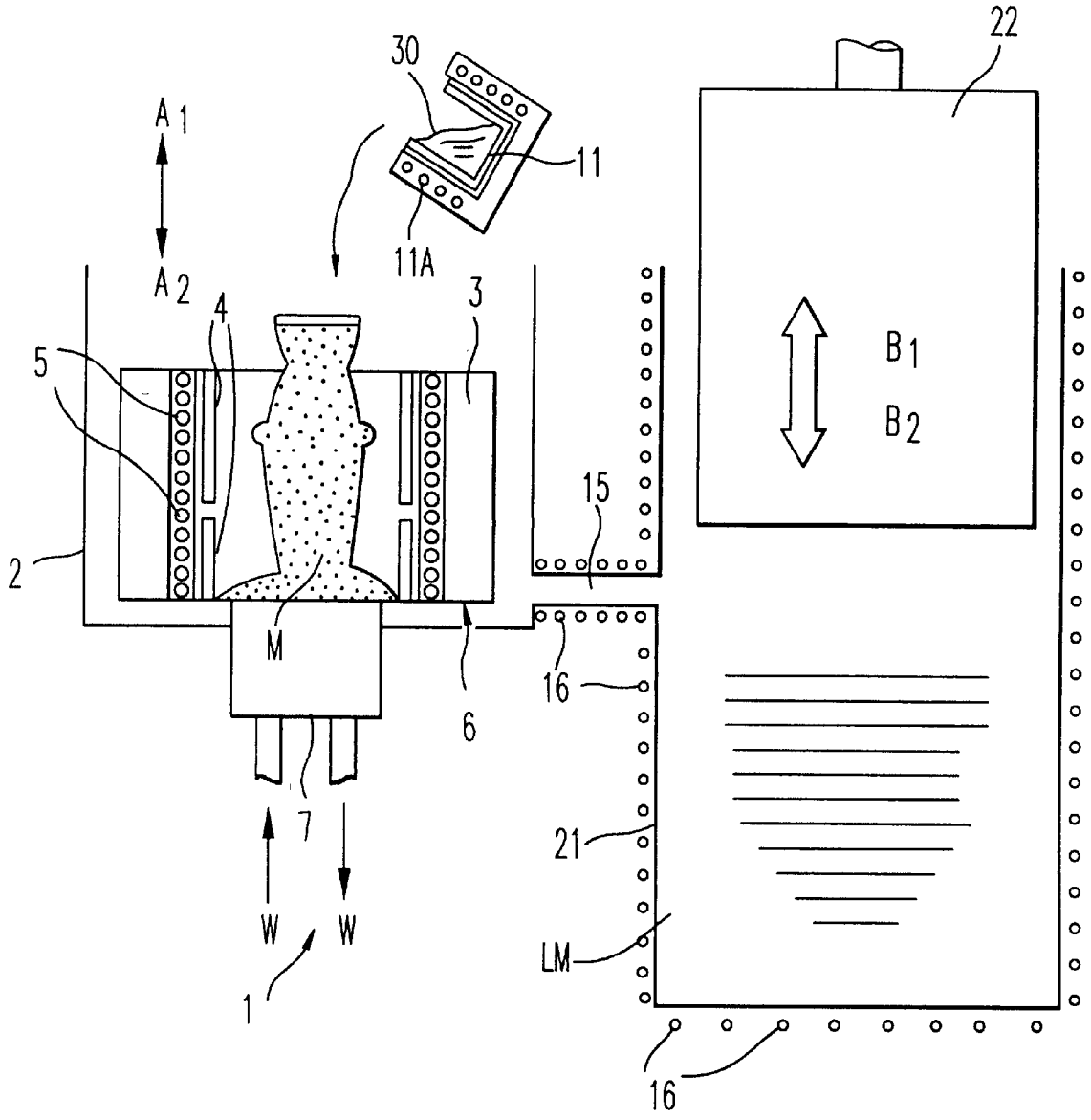
FIG. 1 is a schematic illustration of an embodiment of a casting furnace of the invention.

Referring to FIG. 1, a casting furnace is placed in a vacuum chamber having a vacuum or inert gas atmosphere, for example Ar. The casting furnace 1 consists of a main tank 2; a heating furnace 6 within the main tank and which consists of a heat insulator 3, a susceptor 4 and an induction coil 5; a crucible 11 to feed a molten metal 30 to a mold M within the susceptor 4; a support tank 21 which is connected with the main tank 2 by a connector pipe 15; and a ram 22 which can enter into a cooling liquid metal LM in the support tank 21.

The main tank 2 has the mold M inside and has enough capacity to accommodate the cooling liquid metal. A chill plate 7 is placed at the bottom of the main tank to cool the mold M. The mold M is made of heat resistant materials, for example ceramics, and the chill plate 7 is cooled by a circulation of cooling water W to prevent melting at high temperature. The heat insulator 3 is made of a cylindrical carbon felt, for example, and the susceptor 4 and induction coil 5 are set up inside it.

The induction coil 5 heats up the periphery of a mold M by inductive heating of the susceptor 4 made of carbon, for example. The susceptor 4 is divided vertically in two to differ the temperature at the upper part and the lower part. In addition, the heating furnace 6 can be moved vertically as shown by the arrow marks Al and A2, using a transfer device (not shown).

An induction coil 11*a* is positioned at the periphery of a crucible 11 and casting alloy materials which are put in a crucible are melted by inductive electric current in the crucible. In addition, the crucible 11 may be inclined, in which case molten metal therein is fed to an open gate of a mold M. The crucible 11 can also move vertically with the heating furnace 6.

Heaters 16 surrounding the support tank 21 and the connecting pipe 15 maintain the temperature of the support tank 21 and the connecting pipe 15 so as to prevent solidification of cooling liquid metals LM. Sn or Al, for example, at a temperature of about 700° C., for example, may be used as the cooling liquid metal LM.

The ram 22 is composed of a material which does not dissolve in the cooling liquid metal. It can be moved vertically along arrow marks B1 and B2 by a transfer device which is not shown and can enter into the cooling liquid metal LM in the support tank 21 by moving downward. When the ram 22 enters into the cooling liquid metal LM, the liquid height in the support tank 21 rises correspondingly to the buried volume of the ram 22. The liquid metal LM can thereby be supplied to the main tank 2 through the connecting pipe 15 until the liquid level in the main tank 2 becomes equal to the liquid level in the support tank 21. Consequently, the rising rate of the liquid height in the main tank 2 can be controlled by controlling the speed of lowering of the ram 22.

Figure 3A:
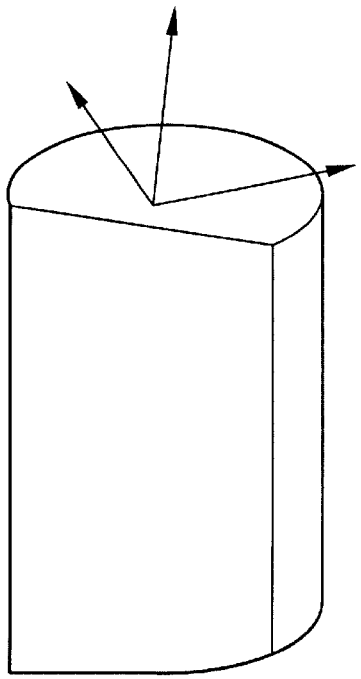
FIGS. 3*a* and 3*b* are perspective views of one example of a single crystal structure 15 (FIG. 3*a*) and of a columnar crystal structure (FIG. 3*b*)
Figure 3B:
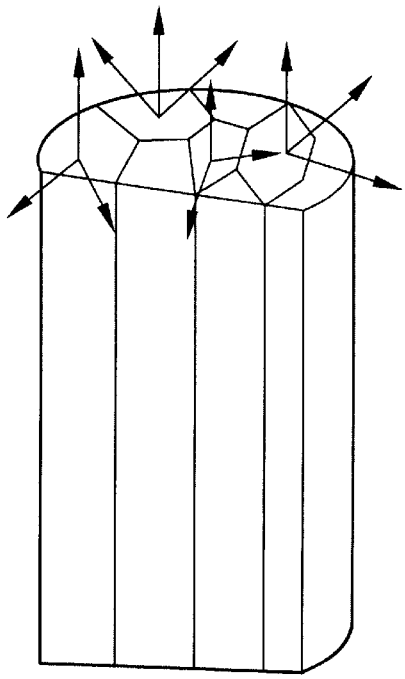

A single crystal structure and a columnar crystal structure of a casting alloy which is made by the casting furnace 1 is shown in FIGS. 3 (*a*) and 3 (*b*). FIG. 3 (*a*) shows a single crystal structure and FIG. 3 (*b*) shows a columnar crystal structure. As shown in FIG. 3 (*b*), in the columnar structure, a predetermined crystal axis is controlled to be uniform and other two axis have random directions.

Figure 4A:
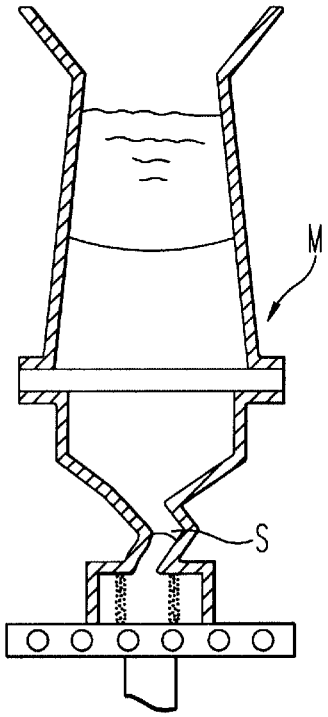
FIGS. 4*a* and 4*b* schematically illustrate examples of a mold for casting a single crystal structure casting alloy (FIG. 4*a*), and a columnar crystal structure casting alloy (FIG. 4*b*)
Figure 4B:
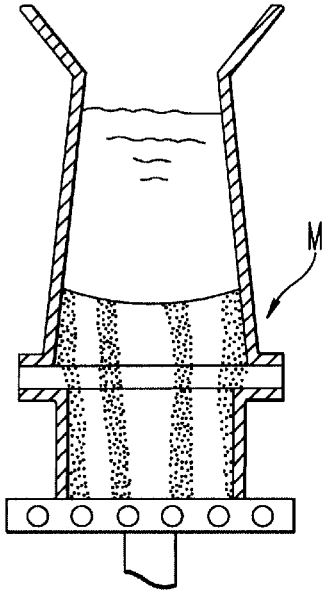

The mold M is shown in FIG. 4 (*a*) is used for casting a single crystal structure alloy. In the mold showed in FIG. 4 (*a*), a selector S is placed at the bottom and acts as a separator such that a single crystal structure is formed. In the case of a casting of a columnar crystal structure alloy, a mold M which has no selector is used, as shown in FIG. 4 (*b*), and the predetermined crystal axis is determined by the direction of solidification.

The mold M is first set on the chill plate 7 which is placed at the bottom of the tank 2 and then the chamber is evacuated or placed under an inert gas atmosphere. Then casting alloy materials are filled into the mold M and are melted by the induction coil 11*a*.

In the case of casting a single crystal structure alloy Ni, base alloys which can be used as casting materials include (weight %), for example: Cr:9~11%, Mo:0.5~0.8%, W:5.5~6.5%, Ta:5.2~6%, Al:5~6%, Ti:1.8~2.5%, Co:4.2~4.9%, Re:0.05~0.5%. Ni:bal (and unavoidable impurities).

Then the periphery of the mold M is heated by heating the susceptor 4 using the induction coil 5. At this time, the temperature is set, for example, to about 1500° C. near the upper part of the susceptor 4, which is divided in two, and is set to about 1600° C. near the lower part of the susceptor 4 in order to create a temperature gradient between the upper part and the lower part of the mold M. At the same time, casting materials in the crucible 11 are melted by the induction coil 11*a* and are caused to flow into the mold M by inclining the crucible 11.

On the other hand, the cooling liquid metal LM in the support tank 21 is kept at a predetermined temperature by heater 16. At this time, the temperature of the cooling liquid metal LM is controlled at, for example, about 700° C. by the induction coil 16.

After molten metal has been introduced into the mold M, the heating furnace 6 is raised at predetermined rate, for example, at 10~50 cm/h. At the same time, the ram 22 is lowered in the support tank 21 and the cooling liquid metal LM is supplied into the main tank 2. At this time, the amount of cooling liquid metal which is supplied into the main tank 2 is controlled to set the liquid height of the surface of the cooling liquid metal LM in the main tank 2 to just under the bottom of the heating furnace 6.

Figure 2:
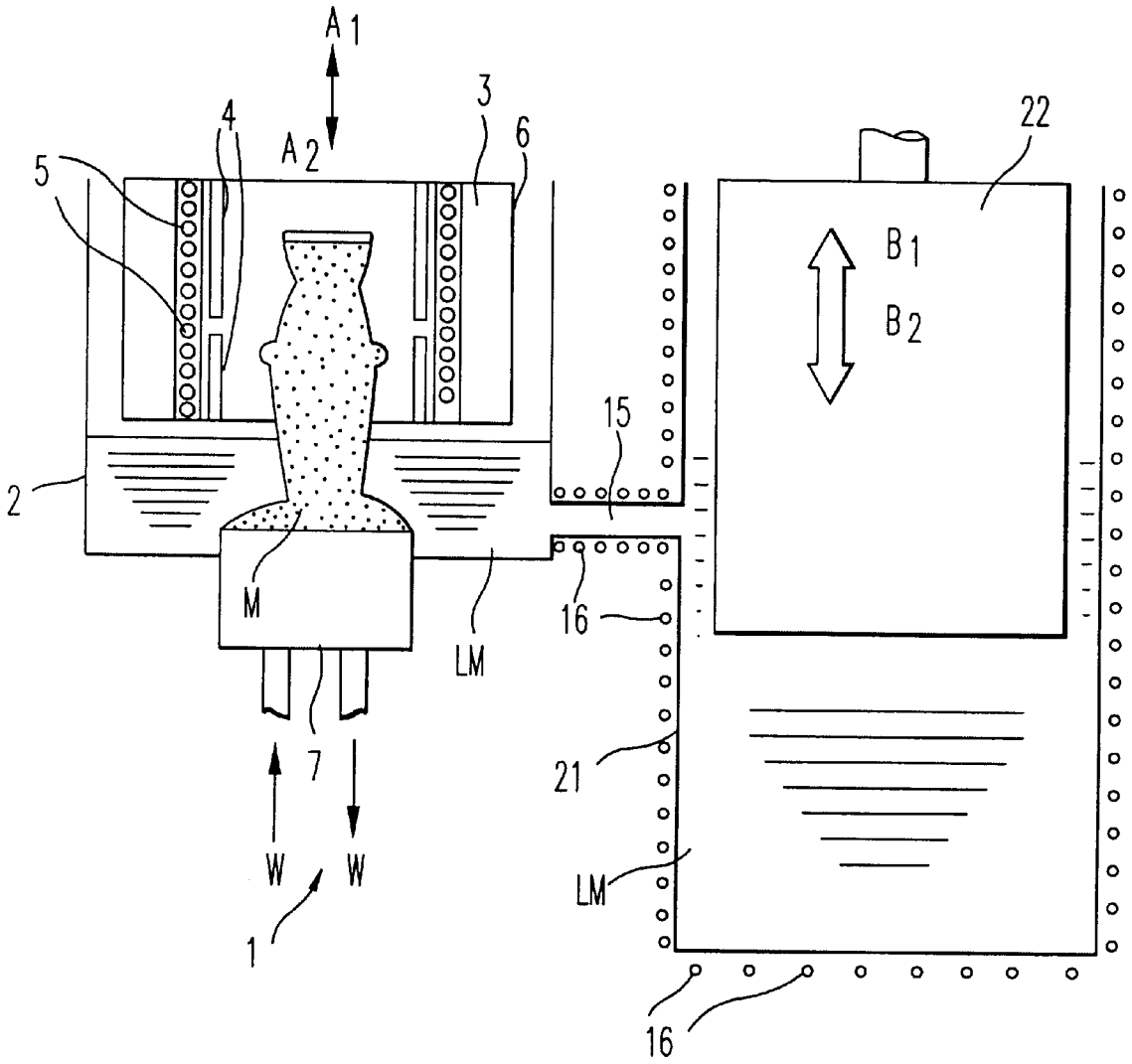
FIG. 2 is an explanatory illustration of casting by using the casting machine of FIG. 1.

Thereafter, as shown in FIG. 2, the rate of lowering of ram 22 is determined so as to roughly equalize the rising rate of the height of liquid metal in main tank 2 to the rising rate of the heating furnace 6 and so maintain the liquid height of cooling liquid metal LM in the main tank 2 to just under the bottom of the heating furnace 6. This rate is calculated by using the cross sectional areas of a ram 22, a main tank 2 and a support tank 21 and may be done automatically by, e.g., a microprocessor controlled controller.

Then the molten metal in the mold M solidifies gradually beginning at the bottom of the mold M. At this time, the surface of the cooling liquid metal remains just under the bottom of the rising heating furnace 6. The molten metal solidifies at or near the boundary area between the heating part (furnace 6) and the cooling part (cooling liquid metal), and the temperature gradient of this area becomes high and roughly constant.

Furthermore, in the case of radiation cooling at the periphery of the mold M, the temperature gradient of this area is about 40–50° C./cm and is under 10° C./cm at the top area of the mold M, but the temperature gradient from top to bottom of the mold M is about 60° C./cm.

Therefore, after solidification, a single crystal structure or a columnar crystal structure of the casting alloy has no defects in the whole length of the mold M. In consequence, in the case of using a long mold, it becomes possible to obtain a good single crystal or columnar crystal structure casting alloy.

Furthermore, by increasing the temperature gradient at the solidification boundary, it becomes possible to increase the cooling efficiency and also to increase the rising rate of the liquid height of the cooling liquid metal. Consequently, it becomes possible to increase the casting rate.

The lowering of the ram 2 is stopped when the liquid height of the cooling liquid metal in the main tank 2 reaches the top of the mold M. This state is kept for 10 minutes, for example, and then the surface of the cooling liquid metal is lowered by raising the ram 22.

After casting is finished a continuous heat treatment is normally done. For example, in the case of an Ni base single crystal alloy, heat treatment is done by keeping the casting at predetermined temperature of between 1240–1270° C. for 30~300 minutes and then keeping the casting at predetermined temperature of between 950–1050° C. for 3~6 hours. Finally, the casting is kept at predetermined temperature of between 850–900° C. for 16~32 hours. By this heat treatment, the casting alloy achieves a homogeneously distributed γ' phase which consists of fine intermetalic compounds and a base γ phase. This alloy has a high strength and corrosion resistance at high temperature.

A turbine blade 40 is fixed on a turbine disk and rotates at high speed in a high temperature combustion gas flow. Since an edge of the blade or a part along its length is exposed to a variable high temperature gas flow, it is necessary that the turbine blade has high temperature strength. Therefore, if the turbine blade consisting of a single crystal structure or a columnar structure is made by the inventive casting method, such a blade has no defects and thus has sufficient high temperature strength.

Figure 5:
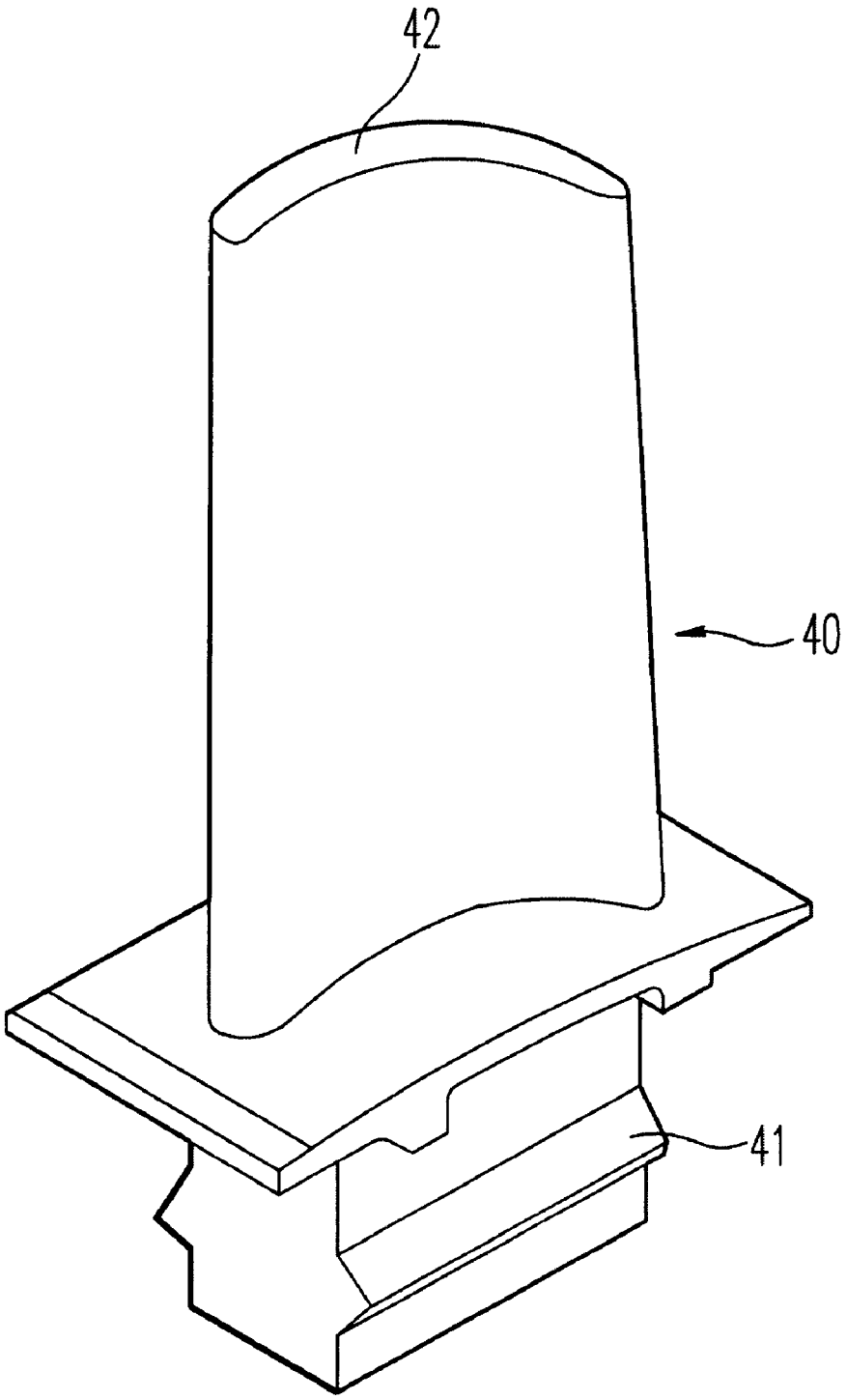
FIG. 5 illustrates a turbine blade made by this invention.

When casting is done, it is necessary, for example, to solidify the blade 40 from the root 41 to the tip 42 or from the tip 42 to the root 4 (FIG. 5). In this way, a predetermined crystal axis is arranged along the length of a turbine blade 40 and it is possible to control the crystal axis, etc. along the length of the turbine blade.

Furthermore, it is possible to raise the height of the cooling liquid metal by pumping a liquid metal or feeding a solid metal instead of using the support tank.

As described above, according to the casting furnace and method of the present invention the temperature gradient at the boundary of solidification becomes high and roughly constant along the whole length of the mold. Therefore, after solidification, a single crystal structure or a columnar crystal structure of a casting alloy has no defects along the whole length of the casting alloy. Accordingly, in the case of using a long mold, it is possible to obtain a casting alloy which has a superior single crystal structure or columnar crystal structure and also has superior high temperature strength.

In addition, since the temperature gradient at the boundary of solidification is high, it becomes possible to increase cooling efficiency, the raising rate of the heating furnace and the raising rate of the liquid height of the cooling metal. Consequently, it becomes possible to increase the casting rate.

Obviously, numerous modifications and variations of the present invention are possible in light of the above teachings. It is therefore to be understood that within the scope of the appended claims, the invention may be practiced otherwise than as specifically described herein.

What is claimed:

1. A casting furnace comprising:

a main tank configured to receive a mold and having sufficient capacity to accommodate a cooling liquid metal;

a heater positioned to heat a periphery of a mold received in the main tank to a predetermined temperature, said heater being mounted so as to be raisable relative to said main tank and any mold received therein; and cooling means for cooling a periphery of a heated mold in said main tank by directing a flow of a cooling liquid metal into said main tank at a rate corresponding to a rate of rising of said heater, thereby immersing the mold in the cooling liquid while the mold is stationary within said main tank.

2. The casting furnace of claim 1, wherein said cooling means comprises:

a support tank connected with said main tank by a pipe said tank having sufficient capacity to accommodate a predetermined amount of the cooling liquid metal, and a predetermined solid volume movable into the liquid metal in said support tank, to thereby transfer cooling liquid to said main tank through said pipe and thereby raise a level of the cooling liquid metal in said support tank.

3. The casting furnace of claim 1 wherein said heater is vertically divided into two sections for heating vertically spaced portions of the mold two at least two temperatures.

4. A casting method comprising the steps of:

heating a mold containing a liquid alloy capable of forming at least one of a single crystal casting and a columnar crystal casting;

progressively immersing the mold in a cooling molten metal at such a rate that the liquid alloy solidifies adjacent the level of the surface of the cooling molten metal;and raising the heater during said progressively immersing step, wherein the level of the surface of the cooling molten metal is maintained adjacent the bottom of said heater as said heater is being raised.

5. A method of forming a single crystal casting or a columnar crystal casting from an alloy, comprising the steps of:

positioning a mold in a within a main tank in at least one of an evacuated and an inert atmosphere;

using a heater surrounding the heater to heat the mold containing a liquid alloy capable of forming at least one of a single crystal product and a columnar crystal product upon solidification;

raising the heater at a predetermined rate; and cooling the mold and solidifying the alloy therein during said raising step by immersing the mold in a cooling liquid metal introduced into the tank at said predetermined rate so that a top surface of the cooling liquid metal is maintained adjacent a bottom of said heater while leaving the mold stationary in the main tank.

6. The method of claim 5 wherein said predetermined rate is such that the liquid alloy is solidified adjacent the top surface of the cooling liquid metal.

7. The method of claim 6 wherein said predetermined rate is 10 to 50 cm/hr.

8. The method of claim 5 including the step of heat treating the casting to form a product.

9. The method of claim 8 wherein the product is a turbine blade.

10. The method of claim 7 wherein said alloy is an Ni based alloy.

11. The method of claim 5 wherein said mold is mounted on a chill plate.

* * * * *

UNITED STATES PATENT AND TRADEMARK OFFICE

CERTIFICATE OF CORRECTION

PATENT NO. : 6,003,587

DATED : December 21, 1999

INVENTOR(S): Akira MITSUHASHI

It is certified that an error appears in the above-identified patent and that said Letters Patent is hereby corrected as shown below:

On the title page, item [30], the Foreign Application Priority Data has been omitted. It should read as follows:

--[30] Foreign Application Priority Data

Jul. 8, 1996 [JP] Japan.....8-177906--

Signed and Sealed this

Thirtieth Day of January, 2001

*Attest:*

*Attesting Officer*

Q. TODD DICKINSON

*Director of Patents and Trademarks*